United States Patent [19]

Hesch et al.

[11] 4,215,515

[45] Aug. 5, 1980

[54] PLUG DOOR ACTUATING MECHANISM

[75] Inventors: Harold E. Hesch, St. John, Ind.; Harold A. Wold, New Buffalo, Mich.; Leonard F. LeMaire, Chicago, Ill.

[73] Assignee: Pullman Incorporated, Chicago, Ill.

[21] Appl. No.: 926,182

[22] Filed: Jul. 20, 1978

[51] Int. Cl.[2] ..... B61D 19/00; E05C 3/04; E05D 15/10

[52] U.S. Cl. ..... 49/218; 105/378; 292/218

[58] Field of Search ..... 105/378; 49/218, 219, 49/220; 292/218

[56] References Cited

U.S. PATENT DOCUMENTS

| | | | |
|---|---|---|---|
| 2,538,203 | 1/1951 | Lehman | 292/218 |
| 3,312,493 | 4/1967 | Olander | 292/218 |
| 4,098,022 | 7/1978 | Hesch | 49/218 X |

*Primary Examiner*—Howard Beltran
*Attorney, Agent, or Firm*—Richard J. Myers

[57] ABSTRACT

An operating rod assembly for use with a sliding plug door of a railway freight car. The operating rod extends vertically and it is connected with a manually actuated mechanism. Both the upper and lower ends of the operating rod are connected with adapter rods of each door crank member which move the plug door into and from the door opening. At both the upper and lower ends of the operating rod there is a telescoping connection between the operating rod and the associated crank. The telescoping connection is secured by a fastener which interconnects the operating rod to each crank attached adapter rod. When the door is in the locked position the fastener is in a captured position adjacent the door to prevent disassembly or accidental separation of the rod members during transit.

5 Claims, 4 Drawing Figures

PLUG DOOR ACTUATING MECHANISM

BACKGROUND OF THE INVENTION (1) Field of the Invention

This invention pertains to railway freight cars having a so-called sliding plug door which moves into and from its associate opening to insure a complete seal and in particular to the operating mechanism.

(2) Description of the Prior Art

The prior art operating rods used to actuate plug doors have generally provided a continuous member between the upper and lower cranks. The continuos member has not been satisfactory because oftentimes dimensional variations occur to the height of the door and the associated support and guide rails, thus making assembly time consuming. Further, in the event the door must be removed for maintenance or replacement, such a one-piece rod must be cut to remove the door.

Further, the prior art arrangements which have utilized attachment of an operating rod to the manually operating actuating mechanism and associated cranks have included fasteners which are prone to shake loose from vibrations or which can be removed from the operating arm by thieves to permit disassembly and opening of the door without breaking the door car seal.

Drawbacks of the prior art are overcome by this invention which provides a telescoping type of connection for connecting an operating rod to the associated door operating cranks and which also is connected to the cranks by a theft-proof and fail-safe fastener which is positioned adjacent the door when the door is in a closed position thus preventing removal of the fastener and disassembly of the operating rod.

SUMMARY OF THE INVENTION

This invention pertains to a door operating mechanism for use with plug doors and in particular to the so-called operating rod of the plug door mechanism which extends vertially from the top to the bottom of the plug door where it is interconnected with door operating crank members. Upon rotation of the operating wheel the operating rod is rotated approximately 90 degrees in such a fashion to move the door into and from the associated door opening.

This disclosure shows an arrangement for connecting the operating rod to its associated cranks wherein a fastener is used and includes an enlarged portion wich is contiguous with the door when the door is in the closed and locked position. By so positioning the fastener, removal by either vibration or thieves is prevented when the door is locked. When a threaded fastener is used, even though the nut may vibrate loose, it is impossible for the fastener to vibrate out of the opening because the adjacent door captures the fastener to prevent disassembly.

It is an object of this disclosure to provide a railway car plug door operating mechanism wherein an operating shaft is provided in such a fashion that it may be easily assembled and has a length that may be varied to conform to the dimensional requirements of each particular car.

It is another object of this invention to provide a door operating rod which is assembled by passing a fastener through an opening having an axis running parallel with the face of the adjacent door and which has an axis perpendicular to the face of the adjacent door when the door is in the locked and closed position.

This and other objects of the disclosure will become apparent to those having ordinary skill in the art with reference to the following drawings, description and claims.

DETAILED DESCRIPTION

Figure 1:
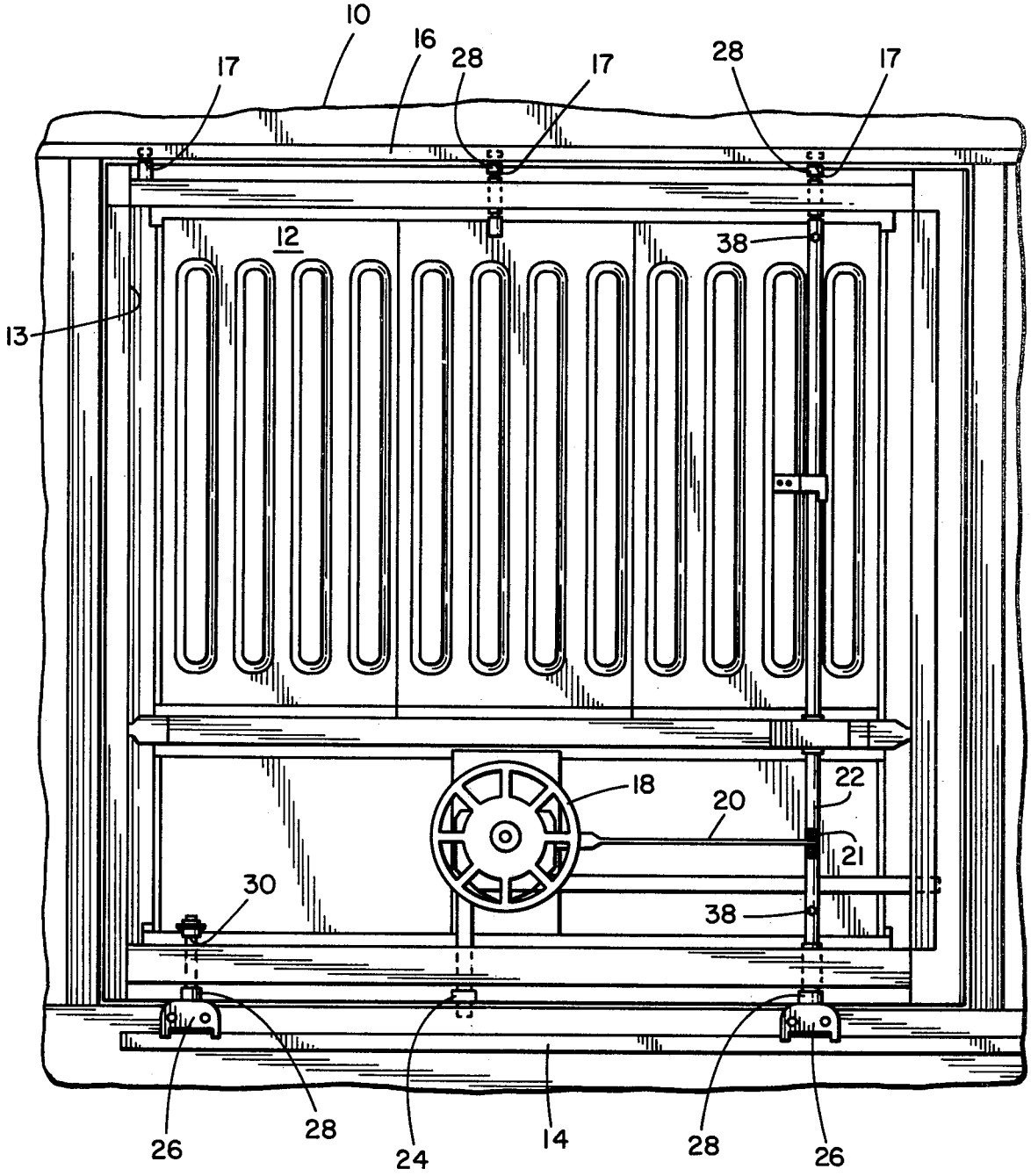
FIG. 1 is a side elevational view of a portion of a railway car using the sliding plug door and mechanism disclosed herein.

Referring now to the drawings and in particular to FIG. 1, there is shown a railroad car designated generally by the numeral 10. The railroad freight car has a sliding door which is generally referred to as a so-called plug door 12. Plug door 12 is mounted upon and carried by a lower support rail 14 which provides the primary and vertical support to the door when the door is in the opened and partially opened postion. When in a closed position, the door is supported by the surrounding framing 13 and the primary loading is removed from the support rail 14.

As shown in FIG. 1, the top portion of the plug door is guided in its lateral and longitudinal movement by a upper guide rail 16.

An operating wheel 18 may be centrally located on the door is manually rotated to open, close, and lock the door. Extending laterally from the operating wheel 18 and its associated mechanism is a connecting arm 20. Arm 20 is connected by means of a short link 21 (FIG. 1) to operating rod 22 which extends vertically for essentially the height of the door. Locking bar 24 and its associated members extended downwardly from the operating wheel 18 and is used to securely lock the door 12 in position once the door has been firmly and securely located within the associated door opening. Once the locking bar 24 is positioned a car seal may be attached at an appropriate location interconnecting the wheel 18 and its mounting plate or otherwise conveniently located to provide an indication that tampering or pilferage has occurred.

Figure 2:
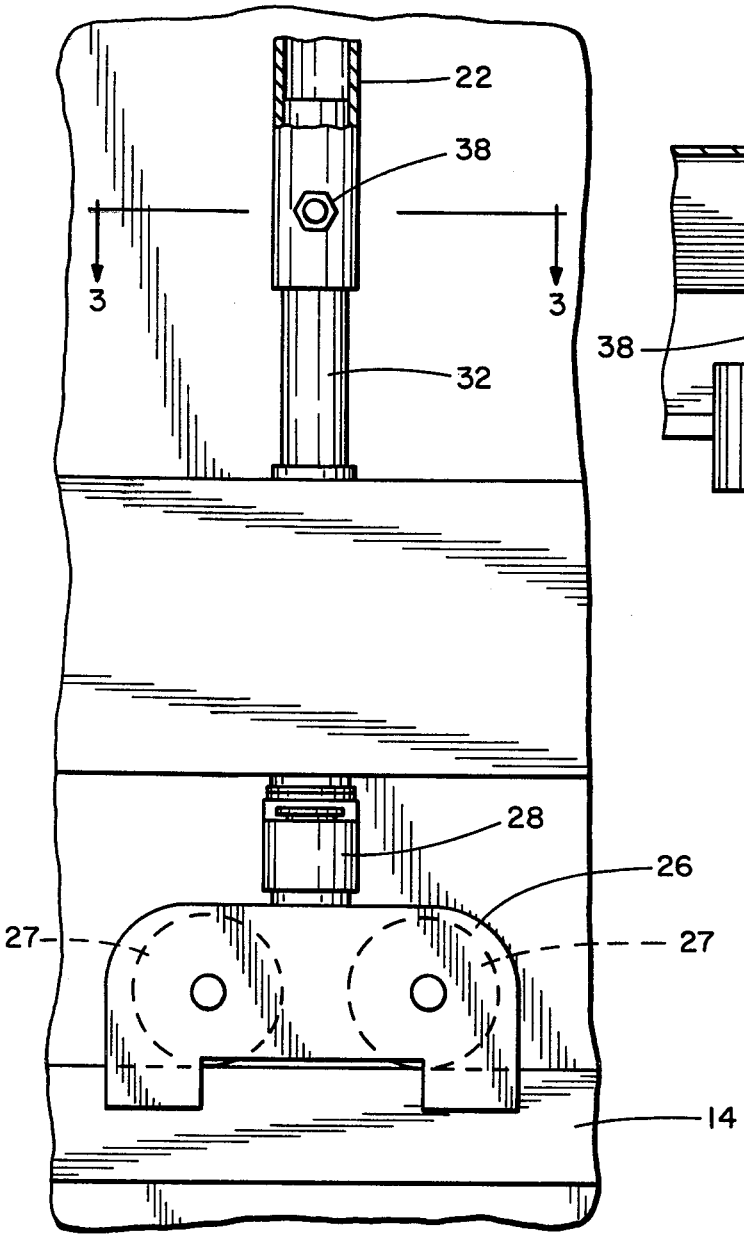
FIG. 2 is an enlarged view of a door support roller, crank and operating rod connection.
Figure 4:
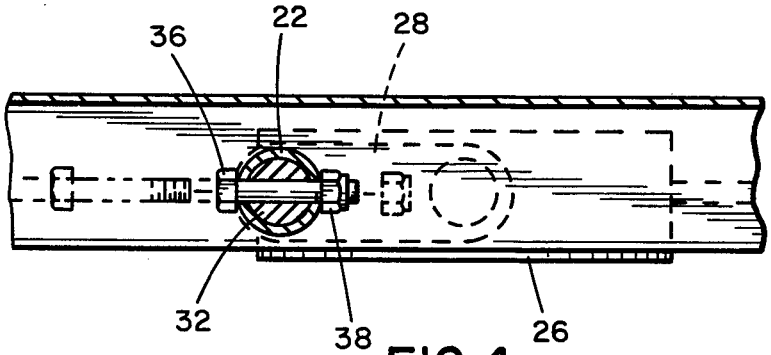
FIG. 4 is a view similar to FIG. 3 showing the location of the members when the door is in open, unlocked position.

Specifically, the door 12 is supported on the lower support rail 14 by at least a pair of guide wheel assemblies 26 which include a pair of rollers 27 (FIG. 2) which permit the door to move easily on the support rail 14. The top portion of the door which also moves into and from the door opening is guided and generally not supported directly by the upper guide rollers 17. Associated with each upper guide roller assembly 17 and each guide wheel assembly 26 is an L-shaped crank assembly 28. Crank assembly 28 provides a connection between the lower support rail 14, the upper guide rail 16 and the door 12. Specifically, each crank assembly 28 which is not connected to operating rod 22 includes a crank rotating shaft 30. As shown in FIG. 1, the wheel assembly 26 and upper guide roller assembly 17 associated with the operating rod 22 is arranged in such a fashion that rotation of the operating rod 22 also rotates the crank 28. Because the roller assembly 26 and upper guide rollers are fixedly positioned and not permitted to move from their captured position on the lower rail 14 and the upper rail 16, when operating rod 22 is rotated the door moves into and from its associated door opening. When the operating wheel 18 is rotated to move the connecting arm 20 from left to right as shown in FIG. 1, the link and the operating rod 22 will move in a counterclockwise direction as viewed from above, This movement places the connecting are 20 in a state of compression. After the plug door has moved transversely from its opening 13 the crank and operating rod 22 will be in the position shown in FIG. 4.

The operating rod 22 provides an outer tube which is attached in a telescoping fashion to the adapter rod 32 which extends from the upper and lower cranks 28. Adapter rod 32 generally includes a pre-formed or drilled opening. During assembly, after the operating rod 22 is fitted about the adapter rods 32 the operating rod may then be drilled with an opening corresponding with the opening of the adapter rod 32. Thus, it is possible to custom fit and locate the adapter rod to each freight car door arrangement without the necessity of adjustment and time-consuming servicing during final assembly because of dimensional variations which can occur from car to car.

Figure 3:
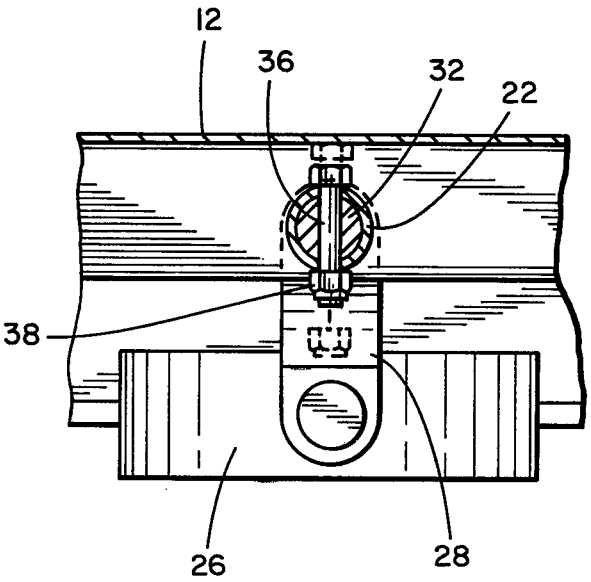
FIG. 3 is a sectional view taken generally along lines 3-13 3 of FIG. 2.

As shown in FIG. 3, a fastener or bolt 36 extends through both the operating rod 22 and the adapter rod 32. The axis of the opening through these two members is parallel with the axis of the crank 28. Thus, when the crank is extending outwardly from the door 12 the axis of the opening through which bolt 36 has been positioned is also perpendicular to the door 12. When the operating wheel is turned to open the door and the crank 28 assumes the position shown in FIG. 4, the fastener 36 will be away from the door and in such a position that it can be easily removed allowing from disassembly of the operating rod 22 from the other associated door operating members.

With this design it is noted that there is a short space between the operating rod 22 and the face of the door 12 when the door is in a closed position. The dimension between the face of the door 12 and the operating rod 22 is shorter than the length of the fastener 36. Thus, if the fastener begins to loosen or is partially disassembled by a thief or vandal, it is impossible to remove the fastener to disassemble the door unless the door is unlocked by rotating the operating wheel 18. The door mechanism including the operating rod 22 and the associated crank 28, must be rotated 90 degrees to the position shown in FIG. 4 in order to remove the bolt 36. Once in the position shown in FIG. 4, the nut 38 may be easily removed to allow for maintenance and repair or servicing of the door members.

Thus, it is noticed that the construction of the operating rod member and the method involved in such construction permits the door assembly to be completed in a simplified, low cost manner without strict adherence to dimensional requirements that have been required in the past. The arrangement disclosed herein also prevents theft and provides an additional factor of safety because the operating rod can not be separated by vibration while the door is in transit.

The foregoing description and drawings merely explain and illustrate the invention and the invention is not limited thereto, except insofar as the appended claims are so limited, as those who are skilled in the art have the disclosure before them will be able to make modifications and variations threin without departing from the scope of the invention.

What is claimed is:

1. A railway car having a sliding door arranged to move laterally between an open and closed position and having a door operating mechanism for locking and or securing the door, the improvement comprising;

a bottom support rail;

a top guide rail;

wheel means mounted on said support rail;

door guide means associated with the top guide rail for guiding the top portion of the door for opening and closing;

lower crank means with means connecting the wheel means with the lower portion of said door;

upper crank means with means connecting the door guide means with the upper portion of the door;

adapter rod means for rotatably connecting the crank means to said door;

operating rod means with means connecting one upper crank means with a lower crank means;

hand operated means for actuating the door operating mechanism and including a connecting means for rotating the operating rod means to move the door laterally between an open and closed position;

said operating rod means and said adapter rod means having end portions fitted together in a telescoping connection;

said telescoping connection having an opening extending therethrough;

connector means positioned in the opening;

said connector means having one end larger than the opening and having a second, smaller end;

said operating rod means being spaced a given distance from said door, said given distance being shorter than the length of the connector means to prevent removal of the connector means when the door is closed and said operating rod means comprising means for rotatably positioning the larger end of the connector means said given distance from the door when the door is in the closed position.

2. The door operating mechanism of claim 1, wherein:

said lower crank means and said upper crank means having means extending at right angles to said operating rod in a generally vertical plane; and said opening of said telescoping connection being generally parallel to said vertical plane of said upper and lower crank means.

3. The door operating mechanism of the claim 2 wherein said connector means includes:

a threaded fastener;

said threaded fastener having a head larger than the associated opening of the telescoping connection.

4. The door operating mechanism of the claim 2 wherein said telescoping connection includes:

a first connection and a second connection at the top and bottom of said sliding door.

5. The door operating mechanism of claim 2 wherein:

said adapter rod means includes a solid bar member;

said operating rod means includes a hollow portion with means to fit about and receive the associated adapter rod means.

* * * * *